United States Patent [19]

Meyer

[11] Patent Number: 4,483,636

[45] Date of Patent: Nov. 20, 1984

[54] SUNTAN OIL APPLICATOR

[76] Inventor: Tracey K. Meyer, 4444 SW. 66 Ter., Davie, Fla. 33314

[21] Appl. No.: 490,303

[22] Filed: May 2, 1983

[51] Int. Cl.[3] ..... A47L 3/30; A45D 40/26

[52] U.S. Cl. ..... 401/266; 132/88.7

[58] Field of Search ..... 401/196, 202, 203, 204, 401/205, 206, 207, 263, 264, 138, 140, 6; 15/104.92, 104.93, 104.94, 167 R, 160, 114, 117, 118, 244 R, 244 A; 132/88.5, 88.7; 604/2, 3, 289, 310, 313, 268, 279

[56] References Cited

U.S. PATENT DOCUMENTS

| | | | |
|---|---|---|---|
| 663,248 | 12/1900 | Sturgis | 401/207 |
| 879,706 | 2/1908 | Watson | 401/140 |
| 1,278,225 | 9/1918 | Schamberg | 15/104.94 X |
| 1,599,708 | 9/1926 | Gedge | 401/207 |
| 2,860,359 | 11/1958 | James | 15/244 A |
| 4,077,725 | 3/1978 | Slautterback | 15/104.94 |
| 4,165,942 | 8/1979 | Johansson | 604/289 |
| 4,183,328 | 1/1980 | Lawrence | 604/2 |
| 4,299,005 | 11/1981 | Brown | 15/104.94 |

FOREIGN PATENT DOCUMENTS

| | | | |
|---|---|---|---|
| 128595 | 12/1928 | Switzerland | 128/66 |

*Primary Examiner*—Richard J. Apley
*Assistant Examiner*—Carolyn A. Harrison
*Attorney, Agent, or Firm*—Melvin K. Silverman

[57] ABSTRACT

There is disclosed a liquid applicator including a deformable elongate tubular member having a proximate end and a distal end in which the distal end is an ellipsoidal or spherical structure. The elongate tubular member has therewithin an elongate supply cavity extending the entire length thereof and terminating in a orifice at the distal end of said tubular member. The proximate end of the tubular member is the point of entry for the addition of liquid to the applicator. At the proximate end, there is detachably mounted an end cap. In association with the distal end of the applicator is a hollow, dispensing head having a socket means for accomplishing a press-fitable rotational connection with said ellipsoidal or spherical structure of the elongate tubular member, such socket means including orifices for the receipt of liquid from the distal end. The dispensing head, which is hollow, includes a reservoir for the receipt of liquid through the orifices of the socket means. The bottom of the dispensing head is defined by a flat or concave application surface, demountably disposed upon the side of the dispensing head opposite to that of the socket means. The fluid application surface exhibits a plurality of orifices which permit the exit of the liquid into a compressible porous pad detachably attached about the entire dispensing head. Through the application of pressure to the deformable tubular member, the liquid is forced through the orifice at the distal end thereof into the dispensing head and, therefrom, through the openings within the flat application surface, and into the compressible porous pad for ultimate deposition upon desired portions of the human body.

7 Claims, 13 Drawing Figures

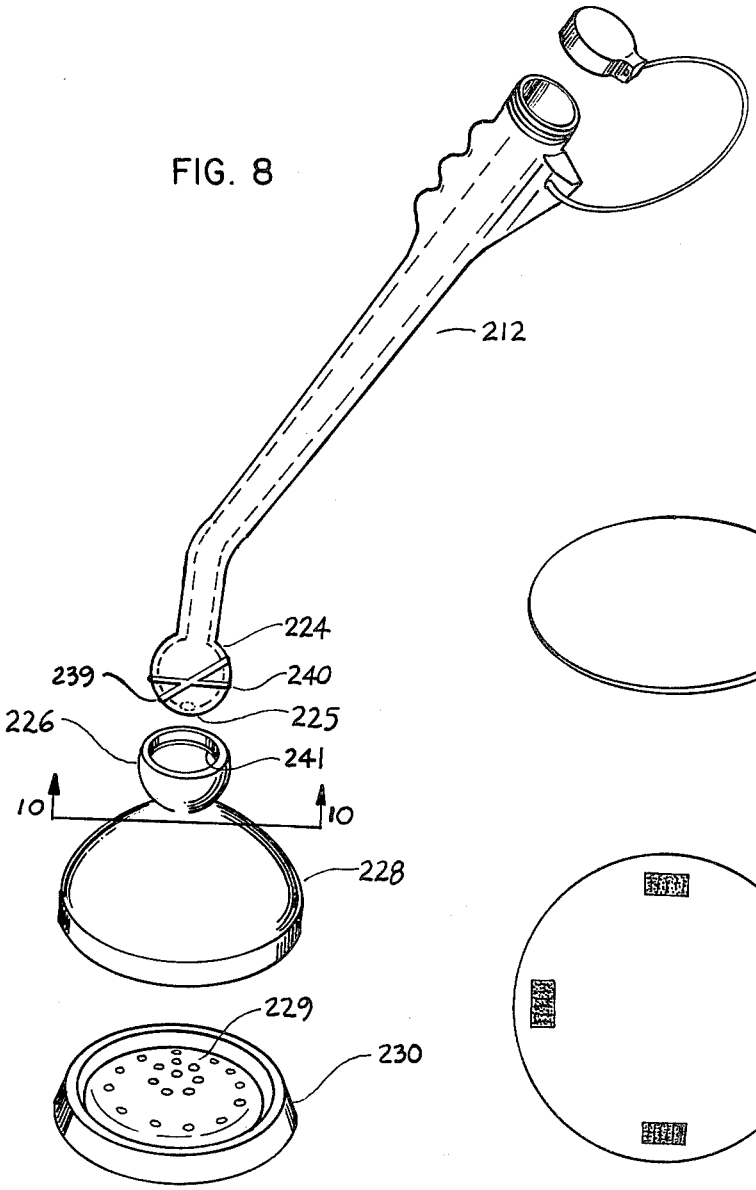
FIG. 8
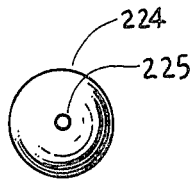
FIG. 9
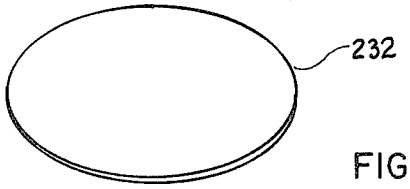
FIG. 11
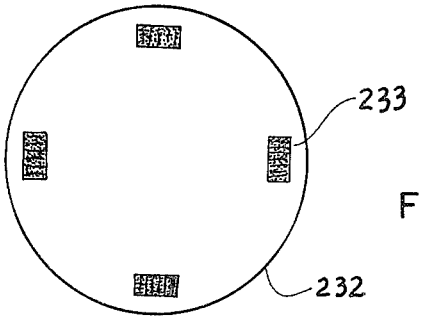
FIG. 12
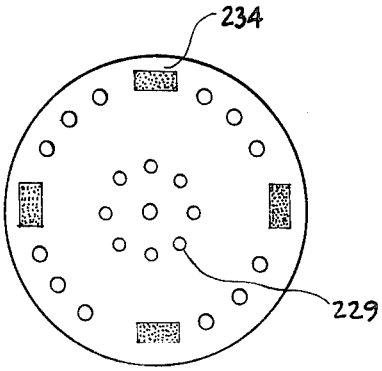
FIG. 13
FIG 10
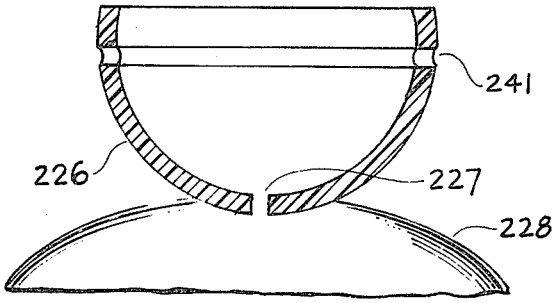

SUNTAN OIL APPLICATOR

BACKGROUND OF THE INVENTION

This invention relates to liquid applicators and, more particularly, to liquid applicating means having particular utility in connection with the application of suntan oil and liquid soap to remote parts of the human body.

It is frequently necessary for a person to apply lotion or other material to his back or other difficult to reach areas. This is usually awkward and, as such, often requires the assistance of another individual. Also, this problem may arise with respect to other relatively inaccessible portions of the body and, further, is a particular problem for the elderly and handicapped. Thusly, it may be appreciated that a need exists for an implement which could aid in the accomplishment of the task of applying lotions, liquid soaps, or the like to remote portions of the human body and, as well, to eliminate the problem of oil becoming unnecessarily smeared upon the user's hands.

In the prior art, certain solutions to this problem have appeared. For example, a long-handled sponge has been employed by persons wishing to apply lotion or oil to their back. Although this is a simple and inexpensive approach, it has certain disadvantages; namely, a requirement of frequent moistening, lack of economy in the usage of oil, and a frequent drying-out or stiffening of the sponge element which, as well, may be subject to undesirable contamination. In addition, this approach and others existent in the prior art, require the frequent transfer of lotion from its original bottle or container to, either directly or indirectly, the surface of the sponge, this obviously requiring a considerable degree of saturation of the sponge in order for the device to function. In brief, the known approaches to the problem have resulted in undesirable waste of oil, lotion, soap or the like, inconvenience in the application of oil to the user's body, and a relatively rapid deterioration of the sponge element of the applicator.

The patented prior art in this area is, to the knowledge of the Applicant, reflected in U.S. Pat. Nos. 2,742,660 to Van Esley and 4,148,318 to Meyer (no relation to Applicant). Other pertinent prior art is U.S. Pat. Nos. 4,078,865 and 4,171,171. Each of said prior art patents related to long-handled liquid dispensing means but, however, in each instance reflects one or more of the above-expressed problems in the prior art. In addition, most of the prior art structures involve considerable complexity of manufacture and, as such, would indicate a retail cost which would put their sale beyond practical use by the "fun-in-the-sun" market, which the Applicant herein seeks to address through her instant invention.

The present invention, and related prior art, is believed to be properly classified in U.S. Class 401, Subclasses 196, 202 and 205.

SUMMARY OF INVENTION

The present invention relates to a liquid applicator including a deformable elongate tubular member having a proximate end and a distal end in which the distal end comprises an ellipsoidal or spherical structure. The elongate tubular member has therewithin an elongate supply cavity extending the entire length thereof and terminating in an orifice at said distal end of said tubular member. The proximate end of the tubular member comprises the point of entry for the addition of liquid to the applicator. At said proximate end there is detachably mounted an end cap. In association with the distal end of the applicator is a hollow, dispensing head having a socket means for accomplishing a press-fittable rotational connection with said ellipsoidal or spherical structure of the elongate tubular member, said socket means including a plurality of orifices for the receipt of liquid from said distal end. The dispensing head, which is hollow, includes a reservoir for the receipt of liquid through the orifices of said socket means. The bottom of the dispensing head is defined by a flat or concave application surface which is a separate element and is demountably disposed upon the side of the dispensing head opposite to that of the socket means. The fluid application surface exhibits a plurality of orifices which permit the exit of the liquid into a compressible porous pad detachably attached about the entire dispensing head. Through the application of pressure to the deformable tunbular member, the liquid is forced through the orifice at the distal end thereof into the dispensing head and, therefrom, through the opening(s) within the flat pancake-like application surface, and into the compressible porous pad for ultimate deposition upon desired portions of the human body.

Accordingly, the principal object of the present invention is to provide a novel and improved long-handled applicator device suitable for the application of oil, liquid soap and other similar materials onto parts of the human body not otherwise easily accessible.

A further object of the invention is to provide an improved lotion dispenser with a holding capacity such that frequent refilling of the applicator will not be necessary.

A yet further object is to provide an improved long-handled dispensing applicator which is compact in size, relatively simple and inexpensive as to construction, and which will provide a changeability of the skin-interface pads.

A still further object is to provide an improved long-handled dispensing applicator which can be easily cleaned, as may be necessary.

The above and other objects and advantages of the invention will become apparent upon a consideration of the following detailed disclosure and claims, these with reference to the accompanying drawings.

BRIEF DESCRIPTIONS OF THE DRAWINGS

FIG. 8 is an exploded view of a third embodiment of the invention.

FIG. 9 is an axial view of the orifice area of the distal end of the tubular member of FIG. 8.

FIG. 10 is an enlarged view of the tongue and groove structure of the socket element in FIG. 8.

FIG. 11 is a view of the outside of an unstretched porous pad of the third embodiment of the invention.

FIG. 12 is a view of the inside of a stretched porous pad used in the third embodiment.

FIG. 13 is a bottom view of the applicator surface of the third embodiment.

DETAILED DESCRIPTION OF THE INVENTION

Figure 1:
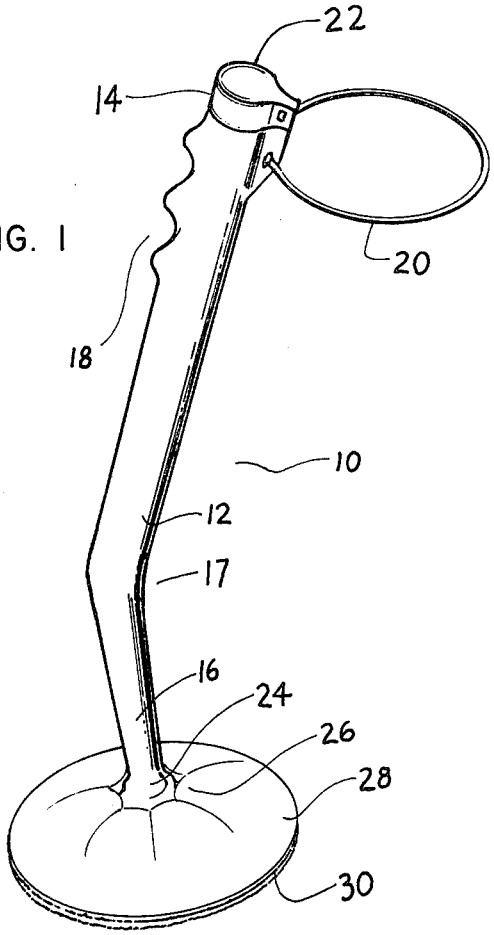
FIG. 1 is a perspective view of the a first embodiment of a liquid applicator.
Figure 2:
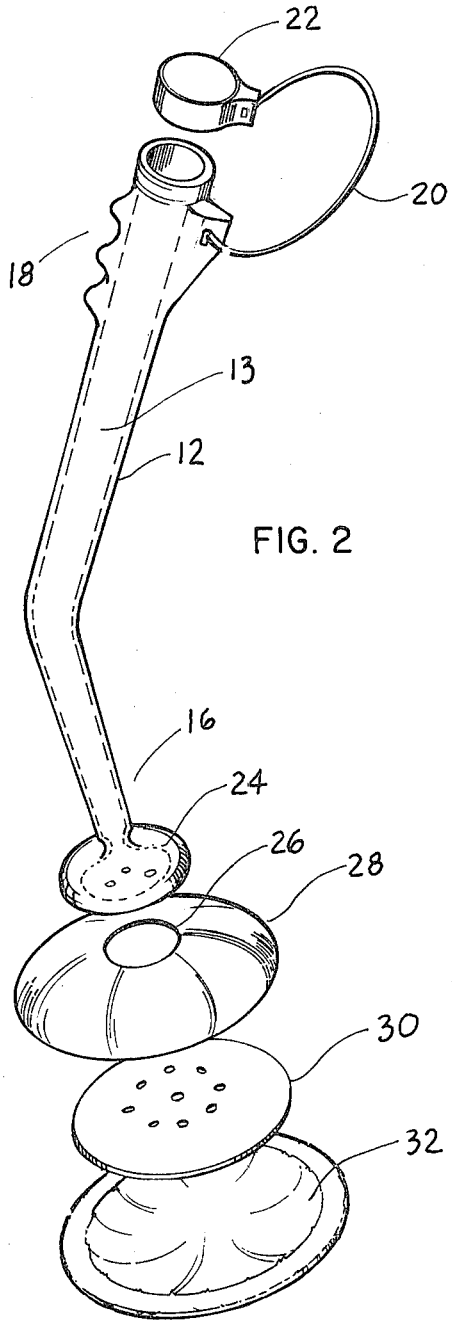
FIG. 2 is an exploded view of the components of said liquid applicator.

With reference to FIGS. 1 and 2, there is shown the various components of the liquid applicator 10. These comprise an elongate tubular member 12, made of a deformable material such as an elastomeric plastic. The tubular member includes a proximate end 14 and distal end 16. At the proximate end is preferrably provided a handle-grip 18, a carrying loop 20, and a demountable end cap 22. The applicator is filled with liquid through the proximate end 14 when the cap 22 is removed. Further, somewhat past midpoint, the tubular member is provided with a bend 17 which, it has been determined, is useful in permitting a user to attain a more effective angle from which to apply the liquid to the desired body area.

At the distal end 16 is provided a ball-like, ellipsoidal structure 24 which is designed to mate with a socket-like structure 26 formed within a dispensing head 28. The ball 24 is snap-fittable into the socket 26, and the fluid flow therebetween is accomplished by the passage of the liquid to be applied from an elongate reservoir 13, through orifice 25, into orifices 27 of the socket 26 and, therefrom, through the dispensing head, and through orifices 29 on a flat application surface 30, which surface is demountably disposed upon the side of the dispensing head 28 which is opposite to the side of said socket 26.

Figure 6:
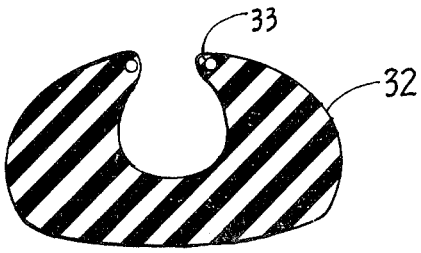
FIG. 6 is a cross-sectional schematic view of the compressible porous pad.
Figure 5:
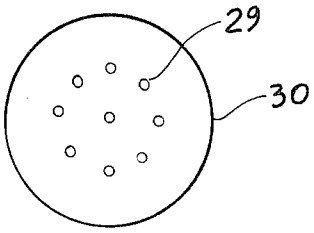
FIG. 5 is a plan view of the face of the flat application surface.

The dispensing head 28, including the flat application surface 30, is covered by a compressible porous pad 32 which is shown in schematic cross-section in FIG. 6 in its unstretched state.

Figure 4:
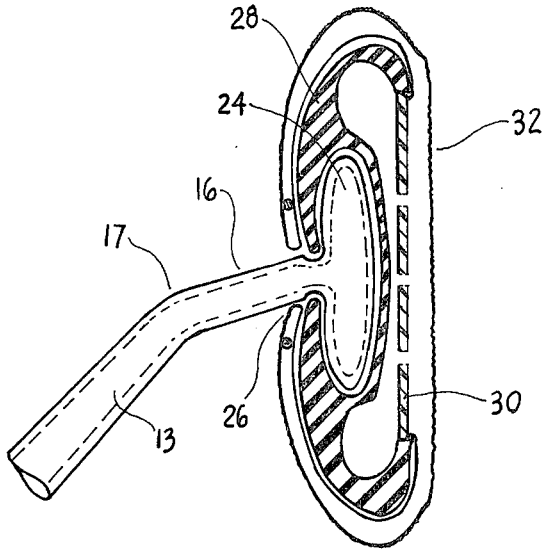
FIG. 4 is a side cross-sectional view of the distal end of the applicator showing the porous absorbent pad in place.

A cross-section of the complete dispensing head area, including the porous pad, is shown in FIG. 4.

It is to be also noted that the present arrangement of parts permits the ready separation and, thusly, cleanability of every component of the system. In particular, it is noted that the elongate tubular member 12 may be disconnected from the dispensing head 28 which may, in turn, be separated from the flat application surface 30. And, it will be noted, the compressible porous pad 32 may be replaced as necessary in order to maintain a fresh, soft and porous interface against the human body.

Figure 3:
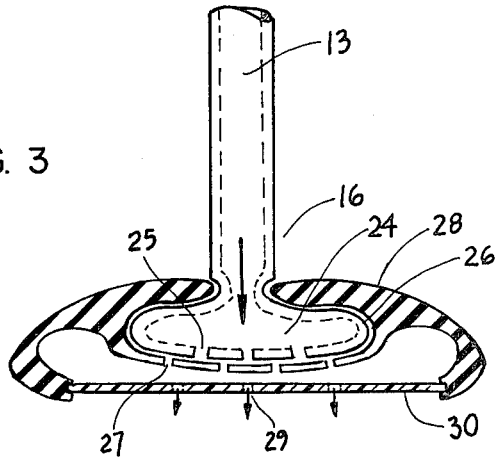
FIG. 3 is a cross-sectional schematic of the dispensing head and associated ball and socket joint of said embodiment.
Figure 7:
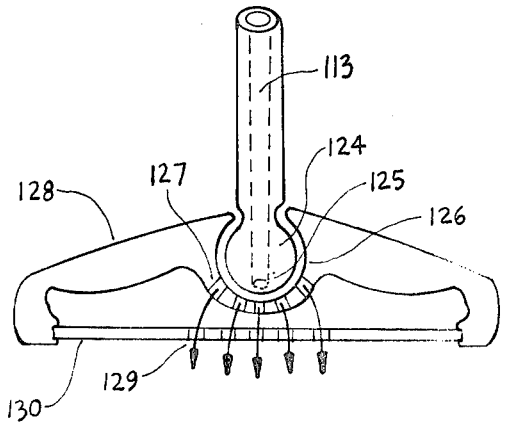
FIG. 7 is a cross-sectional view of a second embodiment of the invention.

A second embodiment of the ball and socket combination is shown in FIG. 7 in which a spherical structure 124 is shown as an alternative to the ellipsoidal structure 24. Similarly, spherical socket 126 is shown as an alternative to the ellipsoidal socket 26 in FIG. 3. In this embodiment, the shape of the dispensing head 128 is slightly modified with relation to the head 28 of the first embodiment. A greater range of movement of the head 128 relative to the handle 112 is afforded in the embodiment of FIG. 7.

With reference to FIGS. 8 through 13, there shown a third embodiment of the present inventive liquid applicator. More particularly, there is shown in FIG. 8 an exploded view of said third embodiment of the invention. In this view it is seen that there is, as in the prior embodiments, provided a deformable elongate tubular member 212, a dispensing head 228, and an application element 230. However, the distal end of the tubular member 212 comprises a spherical element 224, said element being provided with a single orifice 225 and, as well, with circular tongue elements 239 and 240 which cover the entire equatorial length of the spherical element 240. Also the single orifice 225 is analogous to the orifice 125 of the embodiment of FIG. 7. Also, the orifice 225 is, in many respects, similar to the exit orifice used in existing commercial dispensers for suntan liquid and oils.

The dispensing head 228 includes a socket means 226 which is provided with an equatorial groove 241 which is intended for press-fittable communication with the equatorial tongue elements 239 and 240. Thus, it is to be appreciated that the groove 241 may mate with either tongue 239 or 240, depending upon the angle of the head 228 relative to the tubular member 213 that is desired. Also shown in FIG. 10 is an orifice 227 which provides for fluid communication between the socket means 226 and the rest of the dispensing head 228.

Further shown in FIG. 8 is an application surface 230 which is provided with a plurality of orifices 229 which are disposed near to the center of said application surface 230. It is noted that the application surface may be slightly concave with reference to the body surface to which the liquid is to be applied. The application surface 223 is adapted for press-fittable connection to the lower portion of the dispensing head 228.

In FIG. 13, which is a bottom view of the flat application surface 230, it is noted that, in addition to orifices 229, the application surface 230 is provided with a plurality of velcro strips 234. These velcro strips are intended to mate with the velcro strips 233 on porous pad 232 (see FIG. 12). Through the use of such velcro strips 233 and 234, the reusable, disposable porous pads 232 may be readily attached to or from the flat application element 230. This provides an alternative securement means to the elastic means 33 which were above referenced in connection with the use of porous pad 32 in the first embodiment.

There is shown in FIG. 11 the disposable pad in its unstretched condition. As noted, the porous pad of the third embodiment can be smaller (compare with FIG. 6) than the porous pad used in the first and second embodiments, this being due to the above described differences in the nature of attachment of the porous pad to the application element of the dispensing head.

It is to be understood that while there have been shown and described the preferred embodiments of the present invention, the invention may be embodied otherwise than is herein specifically illustrated or described and that in such embodiments certain changes in the detail of construction, or in the form and arrangement of the parts, may be made without departing from the underlying idea or principles of this invention within the scope of the appended claims.

Having thus described my invention what I claim as new, useful and non-obvious and, accordingly, secure by Letters Patent of the United States is:

1. An applicator for disposing liquid upon remote portions of the human body, comprising:

(a) a deformable elongate tubular member having a proximate end and a distal end, the distal end comprising a hollow, ellipsoidal structure, said elongate tubular member having therewithin an elongate supply cavity extending the entire length thereof and terminating in an orifice at said ellipsoidal distal end of the tubular member, the proximate end of said tubular member comprising the point of entry for the addition of liquid to the applicator;

(b) an end cap detachably mountable to said proximate end of said tubular member;

(c) a hollow deformable dispensing head having, in communication therewith, socket means for accomplishing a press-fittable rotational connection with said ellipsoidal structure of said elongate tubular member, said socket means including at least one orifice for the receipt of liquid from said ellipsoidal structure, said dispensing head including a reservoir for the receipt of liquid through said orifices of said socket means, said dispensing head also comprising a substantially flat application surface demountably disposed upon the side of said dispensing head opposite to said socket means, said application surface having therein a plurality of orifices; and (d) a compressible porous pad detachably attached about the entire dispensing head including about the flat application surface, whereby liquid may be effectively advanced through the said elongate tubular member, through said internal reservoir thereof, through the orifice at the distal end thereof, into and through the orifice of said socket means, into the dispensing head and, therefrom, into and through said flat application surface and, therefrom, into said compressible porous pad, thereby effectuating a uniform deposition of liquid upon the body of the user.

2. The applicator as recited in claim 1 in which said ellipsoidal distal end comprises a spherical structure.

3. The applicator as recited in claim 1 in which said elongate tubular member further comprises a hand grip at the proximate end thereof.

4. The applicator as recited in claim 1 in which said elongate tubular member includes a bend near the distal end thereof, whereby a preferred angle of application of liquid to the body surface is thereby obtained.

5. The applicator as recited in claim 2 in which said socket means comprises a spherical structure.

6. The applicator as recited in claim 2 in which said elongate tubular member includes a bend near the distal end thereof, whereby a preferred angle of application of liquid to the body surface is thereby obtained.

7. The applicator as recited in claim 4 in which said socket means comprises a spherical structure.

* * * * *